US005810682A

United States Patent [19]

Carruthers

[11] Patent Number: 5,810,682

[45] Date of Patent: Sep. 22, 1998

[54] HOCKEY STICK BLADE PAD

[76] Inventor: Andrew D. Carruthers, #49-8675 Walnut Grove Drive, Langley, British Columbia, Canada, V1M 2N6

[21] Appl. No.: 593,425

[22] Filed: Jan. 29, 1996

[51] Int. Cl.[6] ..... A63B 53/04

[52] U.S. Cl. ..... 473/528

[58] Field of Search ..... 473/151, 152, 473/153, 155, 156, 198, 199, 329, 330, 342, 344, 378, 528, 529, 530, 560, 561, 562, 563, 288, 588

[56] References Cited

U.S. PATENT DOCUMENTS

| | | | |
|---|---|---|---|
| 699,624 | 5/1902 | Kempshall | 473/329 |
| 2,034,963 | 3/1936 | Barnhart | 473/329 |
| 2,304,322 | 12/1942 | Werlich | 473/562 |
| 2,846,228 | 8/1958 | Reach | 473/332 |
| 2,912,245 | 12/1959 | Gardner et al. . | |
| 4,059,269 | 11/1977 | Tiitola | 473/562 |
| 5,160,135 | 11/1992 | Hasegawa | 473/562 |
| 5,333,861 | 8/1994 | Mills | 473/329 |
| 5,417,419 | 5/1995 | Anderson | 473/329 |
| 5,460,377 | 10/1995 | Schmidt | 473/342 |

*Primary Examiner*—Theatrice Brown
*Attorney, Agent, or Firm*—Long and Cameron

[57] ABSTRACT

A pad for use with a hockey stick having a handle and a blade includes a generally flat pad element capable of covering at least a portion of a side surface of the blade. An adhesive layer securely affixes the pad element to the blade. The pad element is securely affixed to a side surface of the blade such that at least a bottom edge portion of the blade is not covered by the pad element.

7 Claims, 2 Drawing Sheets

HOCKEY STICK BLADE PAD

BACKGROUND TO THE INVENTION

1. Field of the Invention

The present invention relates to a combination of a hockey stick having a blade and an accessory pad on the blade, and to a method of accessorizing a hockey stick blade.

2. Summary of the Prior Art

In order to increase friction between a hockey stick blade and a puck, it is commonly known to wrap a friction tape around the blade of the stick. This effectively increases the frictional contact with the puck, and thus increases the player's control over same. However, the use of friction tape also introduces a number of difficulties.

In particular, snow on the ice surface tends to stick to the friction tape covering the bottom edge portion of the hockey stick blade. This accumulation of snow alters the handling of the stick, and thereby interferes with the player's efforts to control the puck.

On the other hand, when the hockey stick is being used to play ball-hockey, the friction tape tends to adhere to the floor surface. This creates a "jamming" effect of the hockey stick on the floor surface, defeating the player's efforts to control the ball.

U.S. Pat. No. 2,912,245 (Gardner et al.) discloses a hockey stick in which a rubber sleeve is permanently attached about the stick blade. The sleeve is formed with an exterior pattern which simulates the ridges which are formed when tape is wound around the blade in a conventional manner. According to Gardner et al, the sleeve completely envelopes the stick blade, covering the bottom, end and top edge portions of the blade, as well as both of its side faces.

The sleeve of Gardner et al provides frictional contact with the puck which is similar to that which is obtained by the use of conventional tape. However, when the rubber becomes wet from contact with ice during use for ice hockey, it presents a slick surface which is non-functional. Also, due to friction, jamming of the stick while playing floor hockey tends to be increased in comparison to the use of the tape.

A further disadvantage of the prior art is that it is essentially impossible for a player to "customize" his hockey stick by applying a unique colorful design to it. A typical hockey stick carries the manufacturer's name or product identification information printed on the handle. Thus only the blade of the stick is available to the individual player for applying his own designs. However, any such design applied directly to the blade is subsequently obliterated by the application of tape. Furthermore, the tape itself is unsuitable for the formation of a unique design of the player's choosing. Unfortunately, if a design is applied to the blade directly, which is left bare of tape, then the player looses the additional puck control which is provided by the tape.

SUMMARY OF THE INVENTION

An object of the present invention is to provide an accessory pad for a hockey stick blade which acts to increase friction between the hockey stick blade and a ball or puck, without interfering with the player's control over the handling of the stick itself.

Another object of the present invention is to provide a means by which a player can apply a unique and colorful design to the blade of his hockey stick, without significantly sacrificing the puck or ball handling abilities of the stick.

Thus the present invention provides, in combination a hockey stick, the hockey stick comprising a handle and a complete blade at one end of the handle, the blade having a side surface and an accessory pad attached to the blade. The pad comprises a generally flat pad element covering at least a portion of the side surface of the blade and the pad element comprises a cushioning layer of resilient elastomeric material, and a fabric layer bonded to the cushioning layer, with an adhesive securing the pad element to the side surface of the stick, the bottom edge of the blade being free of the pad.

Because the bottom edge of the blade is not covered by the accessory pad, snow accumulation is minimized and contact between the high friction pad and the floor surface is completely eliminated. Consequently, the hockey stick can glide easily over the ice or floor surface so that the player's control over the stick is improved, without sacrificing control over the puck or ball.

In an embodiment of the present invention, the pad element is bonded to the blade with the cushioning layer interposed between the fabric layer and the blade. This arrangement is particularly suitable when the hockey stick is desired to be used for ice-hockey, because the fabric layer provides good frictional contact with a hard rubber puck. The fabric layer can be provided with graphic design.

In another embodiment of the invention, the pad element is bonded to the blade with the fabric layer interposed between the cushioning layer and the blade. In this case, an exterior surface of the cushioning layer is provided with a roughened texture. This arrangement is particularly suitable when the hockey stick is desired to be used for ball-hockey or the like, because the resiliently elastic material of the cushioning layer provides good frictional contact with a plastic ball. In this embodiment, the cushioning layer can be made substantially transparent to visible light, so that a graphic design included in the fabric layer will be visible through the cushioning layer.

A further aspect of the invention provides a method of applying a colorful design to a hockey stick having a blade portion and a handle. The method comprises the steps of providing a pad element including the colorful design; and bonding the pad element to the blade portion of the hockey stick. The pad element comprises a cushioning layer comprised of a resiliently elastic material, and a fabric layer bonded to said cushioning layer. The colorful design is formed on the fabric layer, for example, by a silk-screening process.

BRIEF DESCRIPTION OF THE DRAWINGS

Further objects features and advantages of the present invention will be more readily apparent from the following detailed description thereof given, by way of example, with reference to the appended drawings, in which.

It will be noted that throughout the drawings, like elements are identified by like reference numerals.

DETAILED DESCRIPTION OF THE PREFERRED EMBODIMENT

Figure 1:
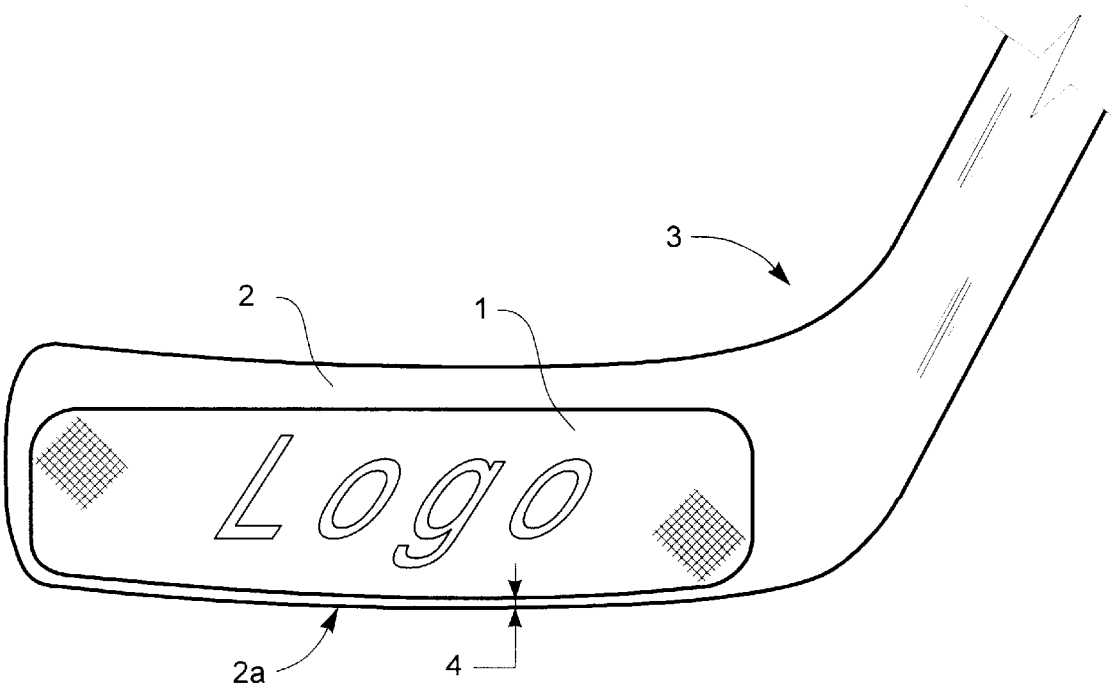
FIG. 1 is a side view illustrating a pad element in accordance with an embodiment of the invention bonded to the blade of a hockey stick.

Referring to FIG. 1, an accessory pad comprising a pad element 1 in accordance with the present invention is adhesively bonded onto the complete blade 2 of a hockey stick 3. The shape of the pad element 1 is essentially arbitrary, and will be selected to substantially cover the entire portion of the blade 2 which is likely to come into contact with a puck or ball (not shown). However, the pad element 1 does not extend down to, or under, the bottom edge portion 2*a* of the blade 2, a small gap 4 being provided between the bottom edge 2*a* of the blade 2 and the corresponding lower edge 1*a* of the pad element 1. By this means, the pad element 1 is maintained out of contact with the ice or floor surface (not shown) throughout the play of a game, even when the blade 2 is angled with respect to the ice or floor surface.

Figure 2:
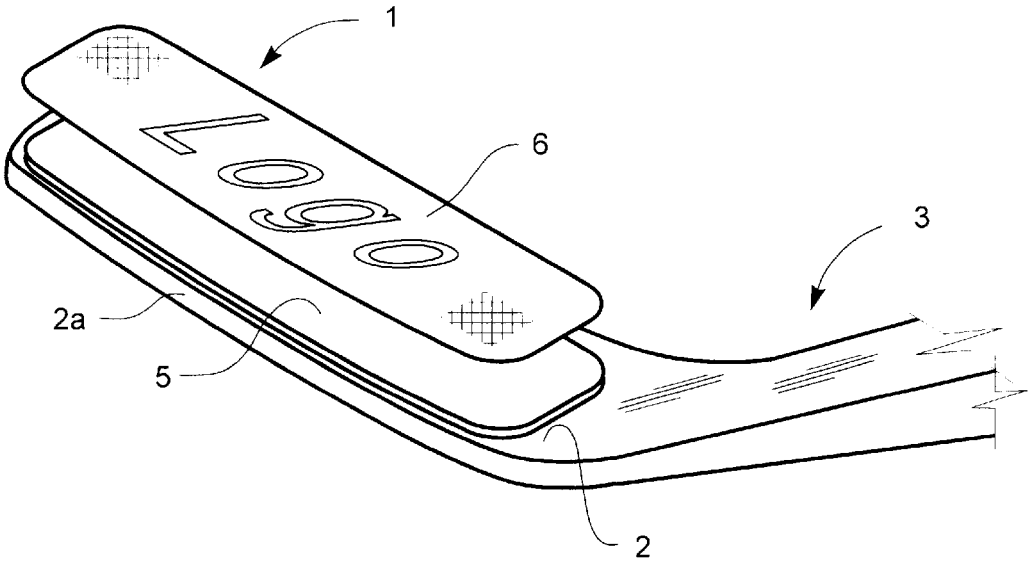
FIG. 2 is an exploded perspective view illustrating the arrangement of layers of a pad element in accordance with a first embodiment of the present invention.
Figure 3:
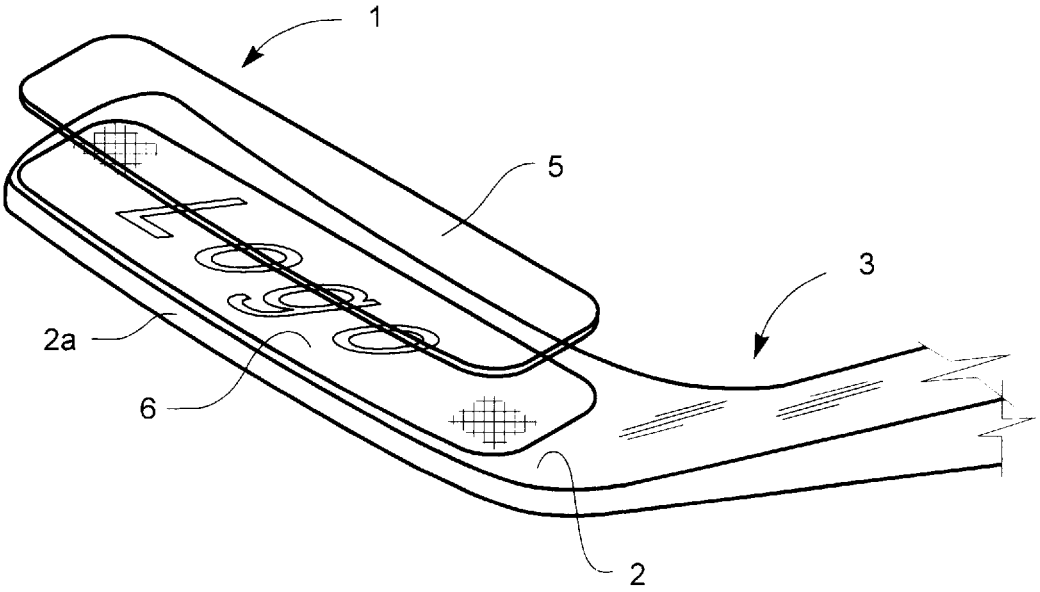
FIG. 3 is an exploded perspective view illustrating the arrangement of layers of a pad element in accordance with a second embodiment of the present invention.

Referring to FIGS. 2 and 3, the pad element 1 is composed of a cushioning layer 5 bonded to a fabric layer 6. The cushioning layer 5 is composed of a suitable resilient elastic material, such as, for example, natural rubber. Preferably, the thickness of the cushioning layer 5 is between 1 mm and 3 mm. The fabric layer 6 is composed of a suitable synthetic material, such as, for example, nylon (tradename), polypropylene, or other synthetic plastic material. A layer of suitable adhesive material is used to bond the pad element 1 to the blade 2 of the hockey stick 3.

Referring now to FIG. 2, in an embodiment of the present invention, the two layers 5 and 6 of the pad element 1 are arranged with the cushion layer 5 interposed between the fabric layer 6 and the blade 2 of the hockey stick 3. This arrangement is most suitable for the playing of ice hockey. In this case, the roughness of the fabric layer 6 provides good frictional contact with the hard rubber puck, and thereby enhances a player's control of the puck. The cushion layer 5 absorbs energy, and thereby helps the player gain control of the puck when receiving a pass, for example.

The fabric layer provides a means for applying a colorful design, such as, for example, a team logo to the hockey stick 3. The design can be printed on the fabric by any suitable conventional processes, such as, for example silk screening, using known inks and/or dyes suitably matched to the material of the fabric.

Known screening and manufacturing processes can be selected to suit the number pad elements to be made. For example, a plurality of designs can be printed on a large sheet of fabric, which is subsequently bonded to a corresponding sheet of cushion material. The pad elements are then cut out from the large sheet, and then either bonded to hockey sticks, or packaged for shipment or storage. This method would be suitable for large production runs, involving a limited number of different designs.

On the other hand, designs can be individually applied directly to the fabric layer of one or more pad elements. While more labor-intensive, this latter approach provides a high degree of variability, and allows players to create and apply unique designs to their hockey sticks.

Referring now to FIG. 3, in a second embodiment of the present invention, the two layers 5 and 6 of the pad element 1 are arranged with the fabric layer 6 interposed between the cushion layer 5 and the blade 2 of the hockey stick 3. This arrangement is most suitable for the playing of floor hockey. In this case, the cushion layer 5 provides good frictional contact with the plastic ball (not shown), and thereby enhances a player's control of the ball. The cushion layer 5 also absorbs energy, and thereby helps the player gain control of the ball when receiving a pass, for example.

As described above, the fabric layer can also be provided with a colorful design, including, for example, a team logo. However, in this case, the cushion layer 5 is made of a material with is transparent to visible light, such as, for example, clear silicone rubber. By this means, the design on the fabric layer 6 is visible through the cushion layer 5.

It will be appreciated that the above embodiments may be varied without departing from the scope of the appended claims. For example, it will be apparent that the pad element of the present invention can be readily adapted for use with playing sticks used in other games, such as, for example, field-hockey. Additionally, it will be recognised that, while the pad element is illustrated as being applied to one side of the hockey stick blade, the pad element can equally be applied to both sides of the blade.

I claim:

1. In combination, a hockey stick, said hockey stick comprising a handle and a complete blade at one end of said handle, said blade having a side surface and a bottom edge, and an accessory pad attached to said blade, said accessory pad comprising a generally flat pad element covering at least a portion of said side surface of said blade, said pad element comprising a cushioning layer of resilient elastomeric material, a fabric layer bonded to said cushioning layer and an adhesive securing said pad element to said side surface of said blade, and said bottom edge of said blade being free of said pad element.

2. A combination as claimed in claim 1, wherein said fabric layer is interposed between said cushioning layer and said side surface of said blade.

3. A combination as claimed in claim 2, wherein printing is provided on said fabric layer and said cushioning layer is transparent to visible light to allow said printing to be visible through said cushioning layer.

4. A combination as claimed in claim 1 wherein, said cushioning pad is provided between said fabric layer and said side surface of said blade, and printing is provided on said fabric layer.

5. A method of accessorizing a hockey stick having a handle and a complete blade at one end of said handle, said blade having a side surface and a bottom edge, said method comprising the steps of providing an accessory pad comprising a fabric layer on a cushioning layer of elastomeric material and securing said accessory pad by adhesive to said side surface of said blade in such a manner that said bottom edge of said blade remains free of said accessory pad.

6. A method as claimed in claim 5, which includes providing said cushioning layer as a layer of material transparent to visible light, providing printing on said fabric layer and interposing said fabric layer between said cushioning layer and said side surface of said blade so that said printing is visible through said cushioning layer.

7. A method as claimed in claim 6, which includes providing printing on said fabric layer and interposing said cushioning layer between said fabric layer and said side surface of said blade.

* * * * *